United States Patent [19]

Ineichen et al.

[11] Patent Number: 4,570,142

[45] Date of Patent: Feb. 11, 1986

[54] PUSHBUTTON-ACTUATED EXCESS-CURRENT SWITCH

[75] Inventors: Kurt Ineichen; Remy Ledergerber, both of Emmenbrücke, Switzerland

[73] Assignee: Weber AG, Fabrik Elektrotechnischer Artikel und Apparate, Emmenbrücke, Switzerland

[21] Appl. No.: 640,816

[22] Filed: Aug. 15, 1984

[30] Foreign Application Priority Data

Aug. 19, 1983 [CH] Switzerland ..... 4537/83

[51] Int. Cl.[4] ..... H01H 71/16; H01H 71/58

[52] U.S. Cl. ..... 337/66; 337/75

[58] Field of Search ..... 337/66, 64, 62, 68, 337/72, 74, 75

[56] References Cited

U.S. PATENT DOCUMENTS 4,044,325 8/1977 Krasser et al. ..... 337/66

*Primary Examiner*—Harold Broome

*Attorney, Agent, or Firm*—Browdy and Neimark

[57] ABSTRACT

A bell-crank-like switching connector is supported on a switch rod having a pushbutton such that it is pivotable and is displaceable along the switch rod. A first lever arm of the switching connector is lockable underneath a protrusion of a bimetallic strip. A second arm bears a contact piece associated with a fixed contact piece. Tabs protrude beyond a latching edge of the first lever arm and upon switching on of the switch they slide over lateral regions of an associated latching edge of the protrusion of the bimetallic strip and thereby make a wear-producing mechanical contact of the two latching edges impossible. The switching connector is exposed to the pressure of a switch spring coaxial with the switch rod. A button spring acting upon the pushbutton and having a substantially smaller spring rate is likewise disposed coaxially with the switch rod and is supported on the switching connector. The contact pressure and the contact separating force are therefore determined practically only by the switch spring. For switching the switch on, the end face of the switch rod presses upon an extension of the second lever arm running on a housing projection, in order to make the contact piece of the second lever arm approach the fixed contact piece and to reduce contact chatter. A recess in the switch rod for the extension causes a long spacing distance between the contacts to be maintained in an unintended tripping position of the switch.

22 Claims, 9 Drawing Figures

Fig. 7
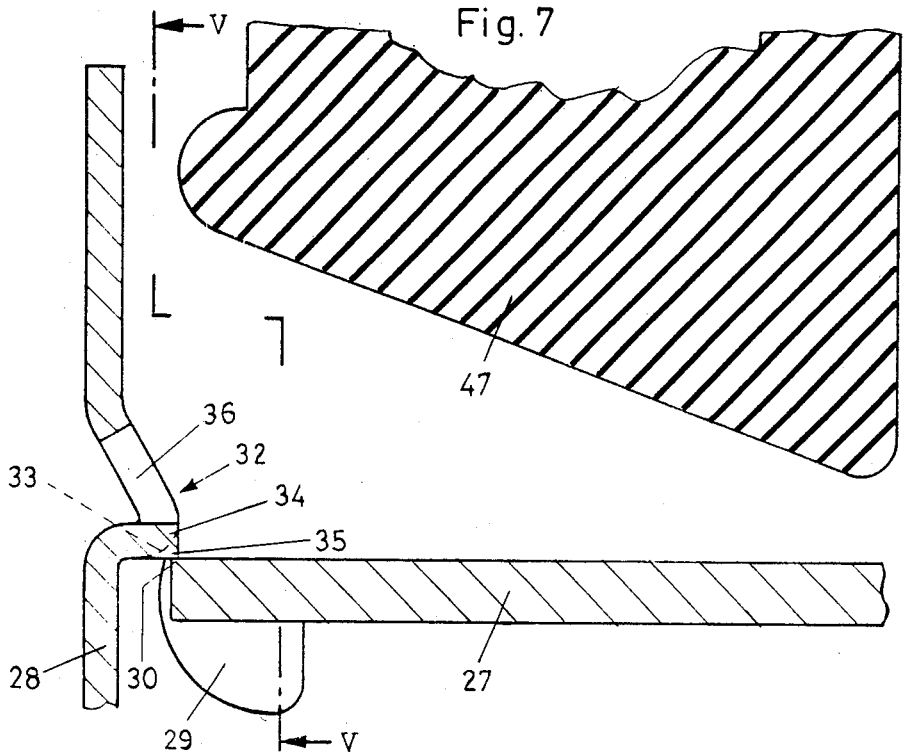
Fig. 9
Fig. 8
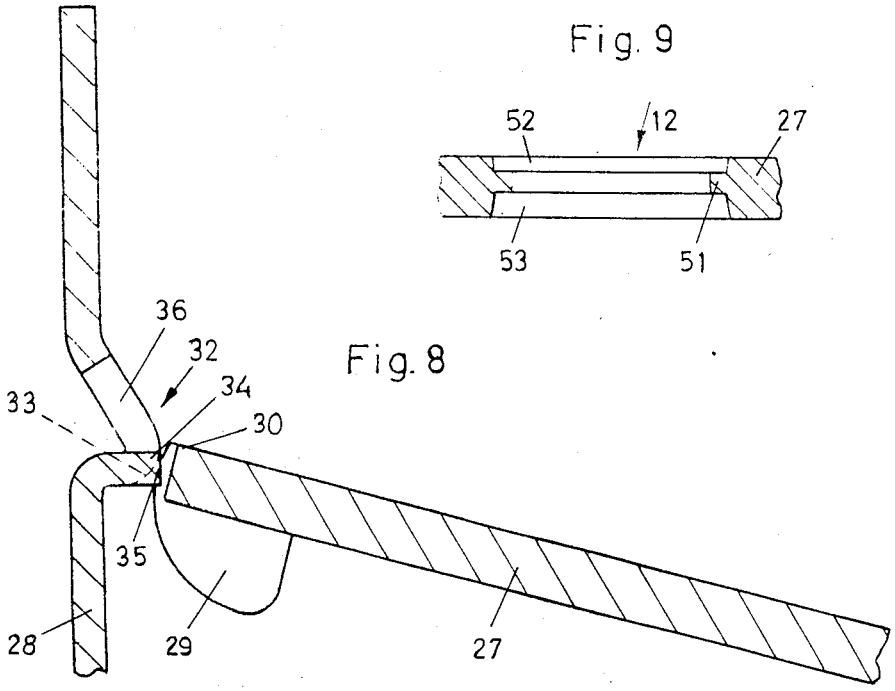

PUSHBUTTON-ACTUATED EXCESS-CURRENT SWITCH

FIELD OF THE INVENTION

The present invention relates to a pushbutton-actuated excess-current switch which is tripped thermally. To this end, a pivotably supported switching connector embodied as a bell crank is displaceable, via a switch rod connected with the pushbutton subjected to the pressure of a button spring, in the direction of the switch rod counter to the force of a switch spring acting upon the switch connector. With one of its lever arms, the switching connector can be snapped into place behind a protrusion of a bimetallic strip such that in the event of a deflection of the bimetallic strip caused by an excess current, the protrusion of the bimetallic strip releases the locked-in end of the first lever arm of the switching connector via respective latching edges on the protrusion and on the end of the lever arm. Another lever arm of the switching connector has a contact piece with which a fixed contact piece of the switch is associated.

BACKGROUND OF THE INVENTION

An excess-current switch of this general type is known, for instance from Swiss Pat. No. 397 895. In this known excess-current switch, as in other similar, known excess-current switches (see German Pat. Nos. 1 072 717 and 1 134 149), a part is secured to the bimetallic strip which has a protruding holder nose for the end of one lever arm of the switching connector. This holder nose has an edge, with which an edge on the end face of the same lever arm of the switching bridge is associated. These two edges act as latching or releasing edges whenever the bimetallic strip, in the event of an excess current, deflects in the direction of a retraction of the holder nose away from the end region of the switching connector lever arm resting on the holder nose. Thus the position of the two associated latching edges relative to one another is the criterion for tripping the excess-current switch in accordance with the deflection of the bimetallic strip, or in other words in accordance with the magnitude and duration of the excess current.

A disadvantage of the known excess-current switches is that upon restarting or switching back on, at least one of the latching edges mentioned is mechanically stressed when, because of the actuation of the pushbutton and the attendant displacement of the switching connector, its end area on the end face that is to be locked into place slides over the holder nose of the bimetallic strip. The resulting increased wear on the latching edges thus impairs the timing constancy of the tripping characteristic of the excess-current switch. A further disadvantage is that in order to form the holder nose, a separate component must be secured to the bimetallic strip, which increases the expense of manufacture and may be the source of further inaccuracies.

In the known excess-current switches mentioned above, the button spring not only has the function of putting the pushbutton into a position corresponding to the OFF position of the switch, but also, via the switch rod, generates the contact pressure of the switching connector upon the fixed contact piece as well as the disconnection force acting upon the switching connector. This has the drawback that to turn the switch on, a considerable actuation force must be exerted upon the pushbutton, and that in the ON or circuit-closing position of the switch the contact pressure is dependent on the pushbutton position, which may vary, for instance if the pushbutton sticks or jams, or after repeated actuation of the pushbutton.

There is the additional disadvantage in the known excess-current switches that on switching the switch ON after one lever arm has locked into place behind the holder nose of the bimetallic strip, the switching connector pivots over the entire disconnection distance between its contact piece and the fixed contact piece, provoking harmful contact chatter.

SUMMARY OF THE INVENTION

It is accordingly a first object of the present invention to devise a pushbutton-actuated excess-current switch of the above-described general type in which the latching edges on the bimetallic strips and on the switching connector can remain free from mechanical contact, without having to attach additional component parts to it.

In accordance with the invention, a bell-crank-like switching connector is supported on a switch rod having a pushbutton such that it is pivotable and is displaceable along the switch rod. A first lever arm of the switching connector is lockable underneath a protrusion of a bimetallic strip. A second arm bears a contact piece associated with a fixed contact piece. Tabs protrude beyond a latching edge of the first lever arm and upon switching on of the switch they slide over lateral regions of an associated latching edge of the protrusion of the bimetellic strip and thereby make a wear-producing mechanical contact of the two latching edges impossible. The switching connector is exposed to the pressure of a switch spring coaxial with the switch rod. A button spring acting upon the pushbutton and having a substantially smaller spring rate is likewise disposed coaxially with the switch rod and is supported on the switching connector. The contact pressure and the contact separating force are therefore determined practically only by the switch spring. For switching the switch on, the end face of the switch rod presses upon an extension of the second lever arm running on a housing projection, in order to make the contact piece of the second lever arm approach the fixed contact piece and to reduce contact chatter. A recess in the switch rod for the extension causes a long spacing distance between the contacts to be maintained in an unintended tripping position of the switch.

It is thereby attained that upon restarting the previously tripped excess-current switch by actuating the pushbutton, the tab or tabs of the switching connector lever arm slide with their protruding portion over the set-back portion of the bending point of the bimetallic strip and deflect the bimetallic strip, so that the end-face latching edge of the switching connector lever arm does not come into mechanical contact with the end-face latching edge of the protruding portion of the bimetallic strip. Since this tab or these tabs, on the top of the lever arm that is to be locked into place, do not protrude beyond the latching edge thereof and thus do not rest on the bimetallic strip when the lever arm has been locked into place, an unhindered latch coincidence is assured until the instant of the unlocking of the two latching edges upon the deflection of the bimetallic strip.

A further object of the present invention is to devise an excess-current switch of the above-described general type in which the button spring has practically no influence upon the contact pressure, which is exerted solely by the switch spring, or upon the disconnecting force. To attain this object the switch spring is made several times stronger than the button spring in one embodiment.

As a result, the stronger switch spring always acts upon the switching connector and generates a constant, great contact pressure as well as a constant, great releasing force, regardless of the position of the pushbutton. The substantially weaker button spring acts directly upon the pushbutton and has only a negligibly slight influence on the contact pressure and the releasing force.

Still another object of the present invention is to avoid, or at least substantially reduce, chatter of the contact pieces when the excess-current switch is switched on.

In one embodiment, when the switch is turned on the switching connector initally pivots in a relatively slow course of movement, in such a menner that the movable contact piece of the switching connector approached the fixed contact piece. Then after one of its lever arms has locked into the place on the protrusion of the bimetallic strip, the switching connector executes a shortened, rapid pivoting movement, which puts the two contact pieces into mechanical contact, thereby practically avoiding the danger of contact chatter.

One exemplary embodiment of the excess-current switch according to the invention will be described below, referring to the drawings.

BRIEF DESCRIPTION OF THE DRAWINGS

FIG. 7 is a section corresponding to FIG. 6 in the position directly prior to the unlocking of the switching connector, taken along the line VII—VII of FIG. 5;

FIG. 8 is a section corresponding to FIG. 6 in an intermediate position while restarting the excess-current switch; and FIG. 9 is a section, on a larger scale, through an opening in one lever arm of the switching connector for guiding it on the switch rod and for supporting the button spring and switch spring.

DESCRIPTION OF THE PREFERRED EMBODIMENT

Figure 1:
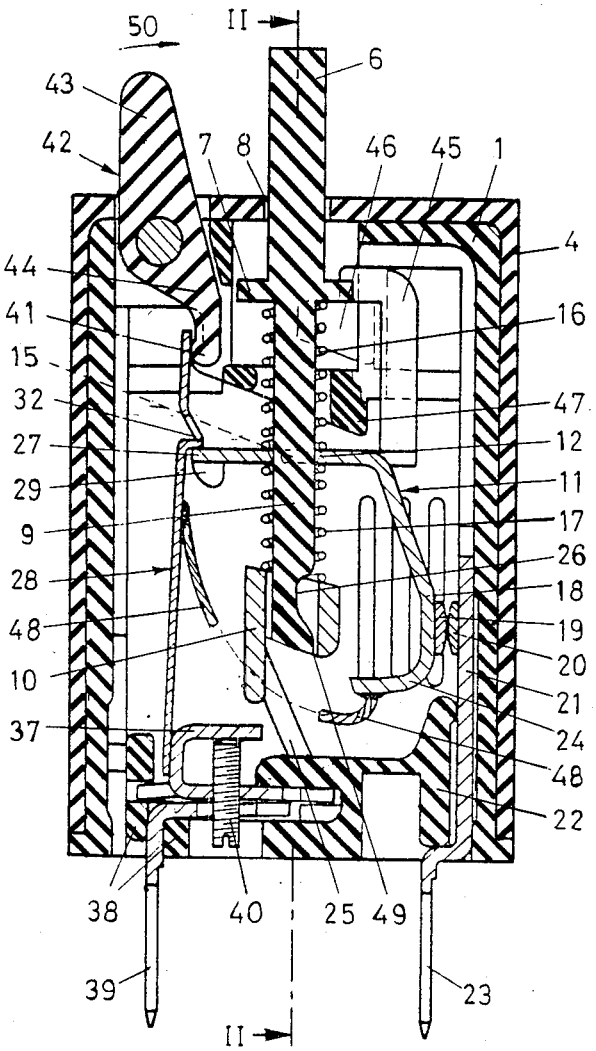
FIG. 1 is a longitudinal section taken through the excess-current switch in its on position.
Figure 2:
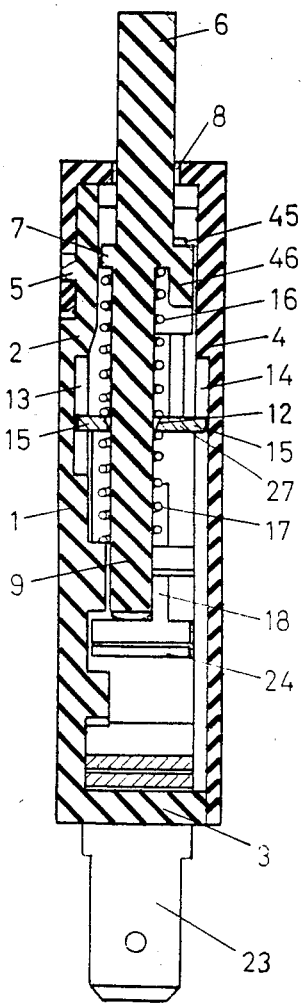
FIG. 2 is a section taken through the excess-current switch along the line II—II in FIG. 1.

In accordance with FIGS. 1–4, the excess-current switch according to the invention has a housing 1 of an insulating material, which embodies one wide side wall 2 and the bottom wall 3 (FIG. 2) of the switch and receives all the component parts of the switch to be described herein. The remaining sides of the switch are closed off by a cap 4, which can be slipped onto the housing 1 from above and is lockable therein by means of a latch protrusion 5.

A pushbutton 6 protruding beyond the cap 4 at its top is slidably guided through a cap opening 8 in the longitudinal direction of the switch and limited at both ends of its longitudinal movement by a formed-on collar 7. The push-button 6 and a switch rod 9 comprise a one-piece unit, the switch rod 9 being supported in a displaceable manner by an internal projection 10 of the housing 1.

A switching connector 11 made of metal is placed upon the switch rod 9, and a corresponding opening 12 in the switching connector 11 is embodied such that the switching connector is pivotable over a limited angle with respect to the longitudinal axis of the switch rod 9 and in addition is displaceable thereon in the longitudinal direction of the switch rod 9. The switching connector 11 is furthermore guided in the longitudinal direction in grooves 13 and 14 (FIG. 2) of the housing 1 and cap 4, respectively, to which end the switching connector 11 is provided with two corresponding pins 15. The groove 14 in the cap 4 extends to the lower edge thereof, so that the cap 4 can be placed upon the housing 1 remote therefrom, if the switching connector 11 2has already been, or still is, mounted upon the switch rod 9.

The switching connector 11 is supported on the switch rod 9 between two compression springs 16 and 17, which are supported with their ends on the switching connector 11. The first spring 16 is supported on its other end on the collar 7 of the pushbutton 7 and serves as the button spring. The second spring 17 is supported on its other end on the projection 10 of the housing 1 and serves as the switch spring. The springs 16 and 17 are dimensioned, at approximately the same positions of rest, such that the spring rate of the button spring 16 is approximately ten times smaller than that of the switch spring 17; in other words, in corresponding operating ranges the switch spring 17 exerts an approximately ten times greater force upon the switching connector 11 than the button spring 16 does in the opposite direction.

The switching connector 11 is embodied as a bell crank and has a first lever arm 18 which is provided with a contact piece 19. Associated with the contact piece 19 is a further contact piece 20 of a fixed contact rail 21, which is held firmly in the housing 1 by an interior projection 22 and as a connection tongue 23 is guided to the outside, passing through the bottom wall 3 of the housing 1. The lever arm furthermore has an extension 24 bent at an angle, the end-face end of which is associated with an interior projection 25 of the housing 1, the latter embodying a running surface for the lever arm 18, as will be explained below. Also associated with the lever arm extension 24 is a recess 26 of the switch rod 9, as will also be explained below.

The switching conector 11 has a second lever arm 27, the end portion of which can lock into place on a bimetallic strip 28. As shown particularly in FIGS. 5–8, the lever arm 27 has a U-shaped cross section in its end portion and accordingly has two lateral, downwardly extending shanks or tabs 29 as well as a rib 31 forming an upper latching edge 30, the tabs 29 being formed by a stamping and bending process. In the longitudinal direction of the lever arm 27, the tabs 29 protrude outward slightly beyond the latching edge 30, but not on the top side of the lever arm 27.

FIGS. 5–8 also show that a bending point 32 is embodied on the bimetallic strip 28. The bending point 32 has two rounded peripheral areas 33 and a central, tongue-like protrusion 34, which has a lower latching edge 35. The tongue-like protrusion 34 is formed out of the material of the bimetallic strip 28 by stamping out an opening 36 and deforming the material in the lower portion of the opening 36. The rounded peripheral areas 33 at the bending point 32 of the bimetallic strip 28 form running surfaces for the end faces of the protruding tabs 29 of the lever arm 27 of the switching connector 11. The underside of the tongue-like protrusion 34 forms a latching face for the rib 31 of the lever arm 27, and the respective latching edges 35 and 30 cooperate during the tripping process.

As shown in FIG. 1, the bimetallic strip 28 is secured to a bimetal carrier 37, which is held firmly between interior projections 38 of the housing 1 and is in electrical contact with a further part carried to the outside and provided in the form of a second connection tongue 39. The bimetal carrier 37 is also provided in a manner known per se with a calibration screw 40, with which the biasing of the bimetallic strip 28 can be adjusted. In the cold, biased or pre-stressed state of rest, the bimetallic strip 28 rests with its end located above the bending point on an interior projection 41 of the housing 1.

A manual release lever 42 is located in the upper portion of the housing 1, projecting with one lever arm 43 all the way through the top of the cap 4 and to the outside next to the pushbutton 6. The other lever arm 44 of the manual release lever 42 is in mechanical contact with the bimetallic strip 28 on the end thereof that rests on the projection 41.

The switching connector 1 is provided with a third lever arm 45, which in the ON position of the switch is locked into place on the top of a projection 46 formed onto the pushbutton 6 (FIGS. 1, 2), in order to keep the pushbutton 6 in an appropriate, partially depressed position counter to the force of the button spring 16, so that the ON position of the switch is recognizable from the outside.

Figure 3:
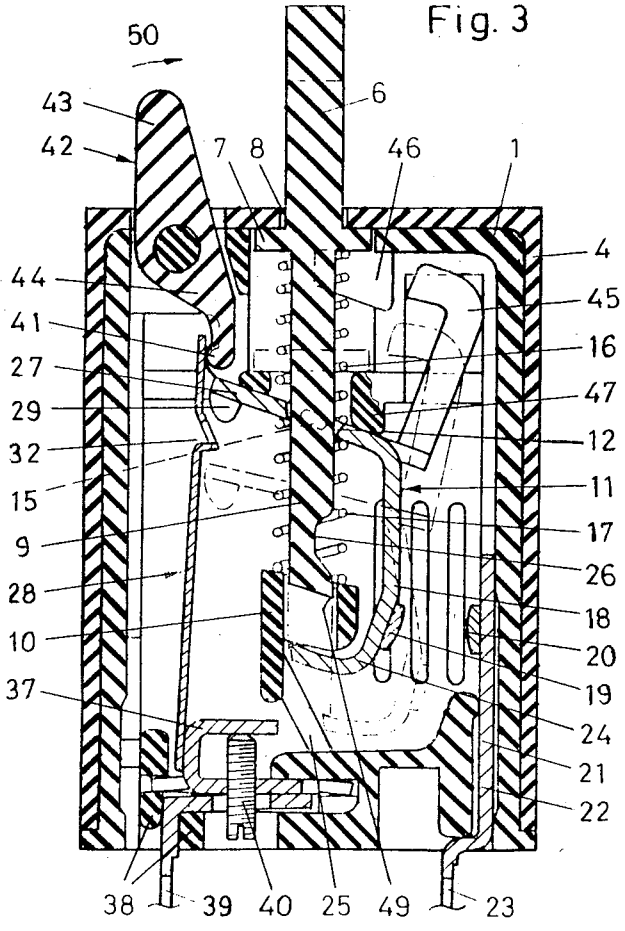
FIG. 3 is a section taken through the excess-current switch of FIG. 1 in the off position of the switch, and in a further position upon restarting the tripped switch shortly before assuming the on position.

A further interior projection 47 of the housing 1 forms a stop for the switching connector 11, or for the lever arm 27 thereof, in the OFF position of the switch, as shown in FIG. 3.

A length of stranded conductor 48, indicated only in FIG. 1, establishes an electrical contact between the bimetallic strip 28 and the lever arm 18 of the switching connector 11, with both of which it is connected. Accordingly, the flow of current in the excess-current switch shown is effected from the connection tongue 39 on the supply side via the bimetal carrier 37, the bimetallic strip 28, the stranded conductor 48 and the extension 24 of the lever arm 18 of the switching connector 11 to the contact piece 19 of the lever arm 18 and, in the ON position of the switch shown in FIG. 1, via the fixed contact piece 20 to the connection tongue 23 on the current-consuming side. The latching location between the bimetallic strip 28 and the lever arm 27 of the switching connector 27 is thus free of electric current. Instead of the directly heated bimetallic strip 28 shown, a bimetallic strip may naturally be provided with a separate heating element instead, in which case the supply of current is effected from the connection tongue 39 to this heating element instead of to the bimetal carrier 37, which is then disposed in an insulated manner.

Figure 4:
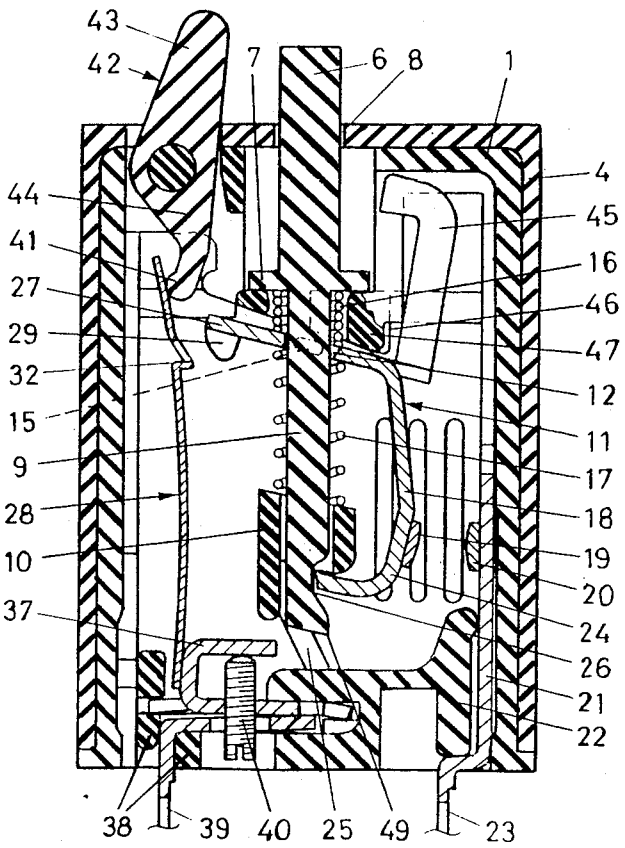
FIG. 4 is a section taken through the excess-current switch of FIG. 1 in the off position, in order to illustrate the free tripping of the switch.

FIGS. 1, 3 and 4 also show that the end-face end of the switch rod 9 has a tripping edge 49, the function of which will be described below. The pivoting direction of the manual tripping lever 42 is also indicated in FIGS. 1 and 3 by means of an arrow 50.

According to FIG. 9, the opening 12 of the lever arm 27 of the switching connector 11 has an inner ring 51, which surrounds the switch rod 9 (FIG. 1) and thus embodies the support for the switching connector 11 on the switch rod 9. On each side of the ring 51, the lever arm 27 has respective recesses 52 and 53, in which the button spring 16 and the switch spring 17, respectively, are located and are supported on the ring 51. As a result, a support of the springs 16, 17 is attained which is independent of the switch rod 9. It is also attained thereby that the button spring 16 in particular, which is made of thin wire, cannot slip in between the lever arm 27 and the switch rod 9 and thereby hinder the movement of the switching connector 11.

The functioning of the excess-current switch shown will now be described, referring to FIGS. 1 and 3–8.

In the ON position of the excess-current switch shown in FIG. 1, the switch spring 17 presses the switching connector 11 upward, counter to the substantially lesser force of the button spring 16, so that, first, the lever arm 27 of the switching connector 11 rests on the tongue-like protrusion of the bimetallic strip 28 and, second, a torque exerted in accordance with the switch spring 17 upon the switching connector 11 presses the contact piece 19 of the switching connector lever arm 18 against the fixed contact piece 20. Since the button spring 16 has a substantially smaller spring rate than the switch spring 17 has, the influence of the button spring 16 on the contact force is very slight, even when, in the ON position of the switch shown in FIG. 1, the pushbutton 6 is actuated.

Figure 6:
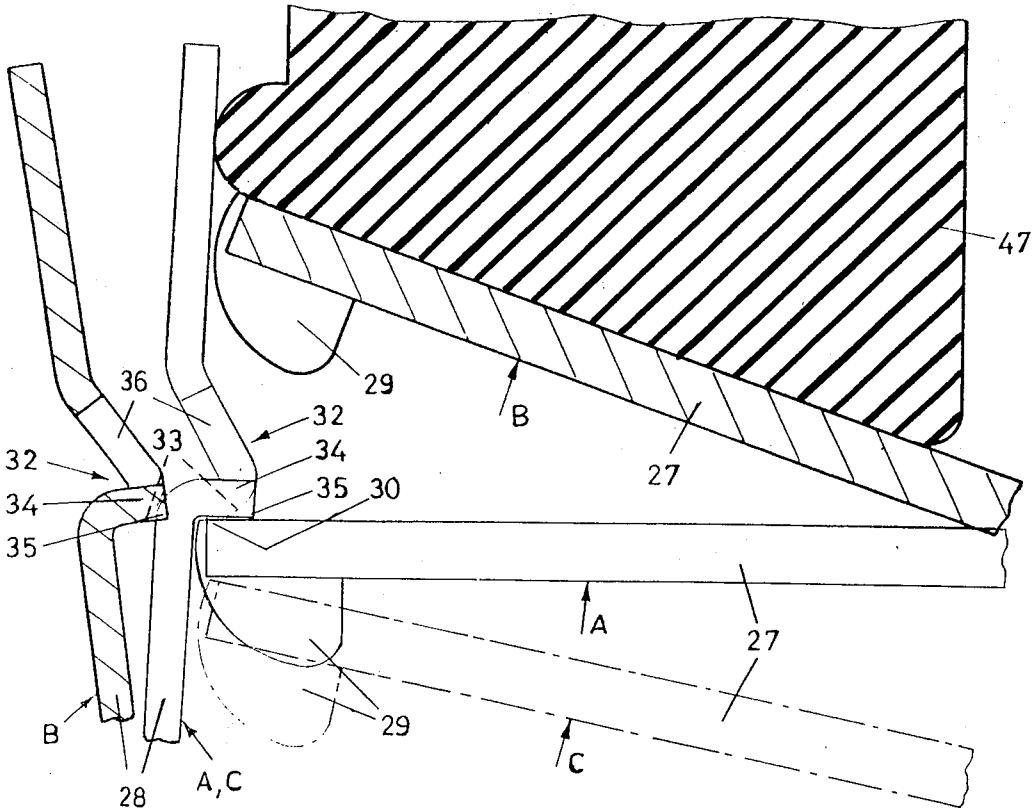
FIG. 6 is a section, on a larger scale, through the bimetallic strip and the same lever arm of the switching connector in its on position, in the off position and in the position in which the pushbutton is fully depressed.
Figure 5:
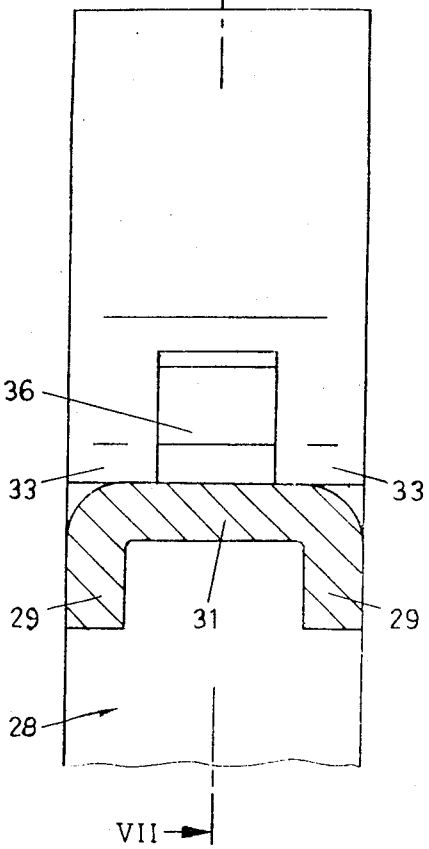
FIG. 5 is a plan view, on a larger scale, of the bending point of the bimetallic strip in a section taken through the end area of one lever arm of the switching connector of the excess-current switch of FIG. 1, taken along the line V—V of FIG. 7.

In the ON position of the excess-current switch shown in FIG. 1, a flow of current accordingly takes place, as already noted, from one connection tongue 39 to the other connection tongue 23. The latching of the lever arm 27 of the switching connector 11 with the bimetallic strip 28 is shown in FIG. 6 on a larger scale, in terms of the positions A of the lever arm 27 and bimetallic strip 28.

The bimetallic strip 28 is heated up by an excess current flowing through it, so that it deflects to the left in FIG. 1, causing the latching coincidence of the lever arm 27 of the switching connector 11 and the tongue-like protrusion 34 of the bimetallic strip 28 to become less; that is, the two latching edges 30 and 35 approach one another, as is shown on a larger scale in FIG. 7.

Upon a deflection of the bimetallic strip 28 dictated by the biasing which is established by means of the calibration spring 40, the latching edge 30 of the lever arm 27 jumps over the latching edge 35 of the bimetallic strip 28. As a result, the switch spring 17 presses the switching connector 11 abruptly upward, counter to the substantially smaller pressure of the button spring 16, whereupon its lever arm 27 strikes the housing projection 47, causing the switching connector 11 to experience a torque in the opposite direction; that is, the switching connector 11 pivots clockwise. Thus during this operation the contact piece 19 of the lever arm 18 is abruptly pulled away from the fixed contact piece 20 and the flow of current is interrupted. The final position of the lever arm 17 on the housing projection 47 is shown in FIG. 3 and also in position B in FIG. 6; in FIG. 3, the bimetallic strip 28 is shown in its position after it has already cooled down again, while in FIG. 6 position B of the heated bimetallic strip 28 is shown. As already noted, the triggering or unlatching of the switching connector 11 described above is effected without hindrance by the lateral tabs 29 of the lever arm 27, because the tabs do not protrude beyond the surface of the lever arm including the latching edge 30.

In the described triggering or pivoting movement of the switching connector 11, the third switching connector lever arm 45 becomes unlatched from the pushbutton projection 46, so that the button spring 16 pushes the pushbutton outward until its collar 7 strikes the upper wall of the cap 4, which signals the OFF position of the switch and is shown in FIG. 3.

To restart the switch shown herein, the pushbutton 6 is actuated by being depressed fully. On the assumption that the bimetallic strip 28 has cooled down again here and has resumed the position of rest shown in FIG. 3, the operation of switching the switch ON proceeds as follows:

Upon the actuation of the pushbutton 6, the switching connector 11 on the switch rod 9 is displaced downward, counter to the force of the switch spring 17, by the end-face end of the switch rod 9, which presses on the extension 24 of the lever arm 18 of the switching connector 11. The protruding tabs 29 of the lever arm 27 now slide on the peripheral areas of the bimetallic strip 28 and bend it outward. Particularly in the vicinity of the bending point 32 of the bimetallic strip 28, the latching edge 30 of the lever arm 27 is thereby prevented from coming into mechanical contact with a portion of the bimetallic strip 28, and the latching edge 35 of the bimetallic strip 28 is prevented from coming into mechanical contact with a portion of the lever arm 27, as shown in FIG. 8 on a larger scale, because the protruding end faces of the tabs 29 keep the two latching edges 30 and 35 spaced apart from one another, and the peripheral areas 33 of the protrusion 34 of the bimetallic strip 28 are rounded off.

In the movement of the switching connector 11 described for switching the switch on, the extension 24 of its lever arm 18 furthermore slides along the obliquely extending housing projection 25, which embodies a running surface for the lever arm 18. As a result, the contact piece 19 of the lever arm 18 on the one hand is made to approach the fixed contact piece 20, and on the other hand is put into a position below the fixed contact piece 20 as shown in FIG. 3. If the pushbutton 6 is depressed virtually completely, the end portion of the lever arm 27 is located below the bending point 32 of the bimetallic strip 28; see the second position of the switching connector 11 shown in FIG. 3 and the position C of the lever arm 27 shown in FIG. 6. Furthermore, the end of the extension 24 of the lever arm 18 of the switching connector 11 is now located in the immediate vicinity of the end-face edge 49 of the switch rod 9. Upon the ensuing release of the pushbutton 6, the lever arm 27 locks into place, under the pressure of the switch spring 17, on the protrusion 34 of the bimetallic strip 28. The switching connector 11 thereby experiences a torque in the counterclockwise direction, so that the extension 24 of the lever arm 18 jumps over the edge 49, acting as a tripping edge, of the switch rod 9. As a result, the torque exerted in a counterclockwise direction upon the switching connector increases abruptly, thereby pressing the contact piece 19 of the lever arm 18 of the switching connector 11 against the fixed contact piece 20. Since the distance by which the contact piece 19 of the lever arm 18 is spaced apart from the fixed contact piece 20 has been temporarily reduced because of the travel of the end face of the extension 24 of the lever arm 18 on the housing projection 25, and because in addition the mechanical contact between the two contact pieces 19 and 20 is of the sliding sort, contact chatter is substantially avoided.

The pivoting movement of the switching connector 11 effected by the described travel of the extension 24 on the housing projection 25 has two more advantageous consequences as well. First, as illustrated by the position of the switching connector 11 shown in dashed lines in FIG. 3, the end of the lever arm 27 of the switching connector 11 is moved by this pivoting movement to below the bending point 32 of the bimetallic strip 28, so that upon an ensuing tripping of the switching connector 11 at the edge 49 of the switch rod 9 a complete latching coincidence is attained at the bending point 32. Second, this pivoting movement of the switching connector 11 causes its third lever arm 45 to partially overlap the projection 46 formed on the pushbutton 6, as shown by the positions of the switching connector 11 and pushbutton 6 shown in dashed lines in FIG. 3. As a result, there is greater reliability that the pushbutton 6 will not move past the switching connector 11, missing it, when the switch is switched on.

As shown in the upper left portion of FIG. 4, the tripping of the switch can also be accomplished by actuating the manual tripping lever 42. If this lever 42 is pivoted in the direction of the arrow 50 (FIGS. 1 and 3), then as a result the bimetallic strip 28 will be bent outward or deflected in the same manner as when it is heated up as the result of an excess current (FIG. 4).

FIG. 4 also shows that whenever the bimetallic strip is in its outwardly deflected position, either because cooling has not yet begun or because the manual tripping lever 42 has been actuated, restarting of the switch (unintended tripping) is impossible, even if the pushbutton 6 is depressed or has become jammed in its depressed position, because the lever arm 27 of the switching connector 11 cannot lock into place at the protrusion 34 of the bimetallic strip 28 and thus the switching connector 11 cannot pivot counterclockwise. The extension 24 of the lever arm 18 of the switching connector 11, once it has jumped over the end-face edge 49 of the switch rod 9, now slides along the depressed switch rod 9, under the pressure of the switch spring 17. In order to avoid an approach of the contact piece 19 of the lever arm 18 toward the fixed contact piece 20 during this sliding movement, and also to attain a large opening distance between the two contact pieces 19 and 20 in the unintended tripping position of the switch shown in FIG. 4, the switch rod 9 is provided with the recess 26, which as the end of the extension 24 of the lever arm 18 slides over it effects a clockwise pivoting movement of the switching connector 11.

The present excess-current switch can additionally be provided with an electromagnetic tripping device, known per se, which is preferably embodied and disposed on the housing 1 such that in the case of short-circuiting it deflects the bimetallic spring 28 in the same manner as when the manual tripping lever 42 is actuated.

Not only does the present excess-current switch have the advantages of reducing the wear on the latching edges of the switching connector and bimetallic strip, of restarting with low contact chatter, and of having a large spacing distance between the contacts in the unintended tripping position, but it is also made up of a very low number of individual component parts, which furthermore can be manufactured at low cost and be effortlessly mounted in the switch housing.

It is to be understood that the present invention is not limited to the embodiments disclosed which are illustratively offered and that modifications may be made without departing from the invention.

What is claimed is:

1. A pushbutton-actuated excess-current switch having thermal tripping, comprising a pivotably supported switching connector including a bell crank which is displaceable, via a switch rod connected with the pushbutton subjected to the pressure of a button spring, in the direction of the switch rod counter to the force of a switch spring acting upon the switching connector and with one of its lever arms locking into place behind a protrusion of a bimetallic strip, in such a manner that upon a deflection of the bimetallic strip caused by an excess current the protrusion of the bimetallic strip releases the locked-in end of the first lever arm of the switching connector via respective latching edges of the protrusion and of the end of the lever arm, another lever arm of the switching connector being provided with a contact piece with which a fixed contact piece of the switch is associated, wherein the bimetallic strip has a bending point, on which a protrusion protruding out from the bimetallic strip and having an end-face latching edge as well as a region set back with respect to the latching edge and located in the transverse direction of the bimetallic strip next to the protrusion are formed, and the locking-in lever arm of the switching connector has in its end portion an end-face latching edge as well as at least one tab formed on next to it in the transverse direction, which tab protrudes in the longitudinal direction of the lever arm beyond the latching edge thereof. and protrudes beyond the lever arm at right angles to the latching edge on the side remote from the latching edge.

2. An excess-current switch as defined by claim 1, wherein the protrusion of the bimetallic strip having the latching edge is formed out of the material of an opening in the bimetallic strip provided at the bending point, which protrudes in knee-like fashion toward the first lever arm, and that this protrusion has rounded-off peripheral areas on both sides.

3. An excess-current switch as defined by claim 1, wherein the end portion of the first lever arm of the switching connector has a U-shaped cross section in order to form two lateral tabs.

4. An excess-current switch as defined by claim 1, wherein the switching connector is supported on the switch rod such that it is pivotable between the button spring, which is supported on the pushbutton, and the switch spring, which is supported on a stationary housing projection, and such that it is displaceable along the switch rod, the spring rate of the switch spring being several times larger than that of the button spring.

5. An excess-current switch as defined by claim 1 wherein the second lever arm of the switching connector, provided with the contact piece, has a bent portion extending outward past its contact piece, upon which portion the end-face end of the switch rod acts upon an actuation of the pushbutton, in order to displace the switching connector.

6. An excess-current switch as defined by claim 5, wherein associated with one end face of the bent portion of the second lever arm is a stationary running surface, along which said end face slides upon the action of the switch rod upon the bent portion, in order by pivoting the switching connector to effect an approach by the contact piece of the second lever arm toward the fixed contact piece.

7. An excess-current switch as defined by claim 5, wherein the end-face end of the switch rod has a tripping edge for the bent portion of the second lever arm.

8. An excess-current switch as defined by claim 5, wherein the switch rod has a lateral recess for the end face of the bent portion of the second lever arm, in order in the unintended tripping position of the switch, upon an actuation of the pushbutton, to keep the contact piece of the second lever arm spaced apart from the fixed contact piece.

9. An excess-current switch as defined by claim 1, wherein the switching connector has a third lever arm, which in the position for switching the switch ON is lockable into a projection of the pushbutton, in order to hold the pushbutton firmly in a position corresponding to the switching-on position, counter to the force of the button spring.

10. An excess-current switch as defined by claim 1, including a manual tripping means having an actuation lever acting upon the bimetallic strip in order to deflect it outward.

11. A pushbutton-actuated excess-current switch having thermal tripping, comprising a pivotably supported switching connector including a bell crank which is displaceable via a switch rod connected with the pushbutton subjected to the pressure of a button spring, in the direction of the switch rod counter to the force of a switch spring acting upon the switching connector and with one of its lever arms lockable into place behind a protrusion of a bimetallic strip, in such a manner that upon a deflection of the bimetallic strip caused by an excess current the protrusion of the bimetallic strip releases the locked-in end of the first lever arm of the switching connector via respective latching edges of the protrusion and of the end of the lever arm, another lever arm of the switching connector being provided with a contact piece with which a fixed contact piece of the switch is associated, wherein the switching connector is supported on the switch rod such that it is pivotable, with respect to the longitudinal axis of the switch rod and it is displaceable along the axis of the switch rod, the button spring is supported at its one end on a projection of the switch rod, and at its other end rests on an upper one of two opposite faces of the switching connector, the switch spring is supported at its one end on a stationary housing protection located near the end of the switch rod opposite to the pushbutton, and at its other end rests on a lower one of said opposite faces of the switching connector, the spring rate of the switch spring being several times greater than that of the button spring.

12. An excess-current switch as defined by claim 11, wherein the lever arm of the switching connector that is lockable in place behind the protrusion of the bimetallic strip has an opening for receiving the switch rod, in which opening an annular support from the switch rod is formed, which support on the two sides of the lever arm forms a bearing surface for the button spring and the switch spring respectively, the two springs being disposed on the switch rod.

13. An excess-current switch as defined by claim 11, wherein the second lever arm of the switching connector, provided with the contact piece, has a bent portion extending outward beyond its contact piece, upon which bent portion the end-face end of the switch rod acts upon an actuation of the pushbutton, in order to displace the switching connector.

14. An excess-current switch as defined by claim 13, wherein the stationary housing projection supporting the switch spring is embodied as a longitudinal guide for the switch rod and is disposed with respect to the switch rod such that upon an actuation of the pushbutton the end of the switch rod acting upon the bent portion of the second lever arm protrudes outward beyond the housing projection.

15. An excess-current switch as defined by claim 13, wherein a stationary running surface is associated with one end face of the bent portion of the second lever arm, along which running face said end face slides upon the action of the switch rod upon the bent portion, in order by pivoting the switching connector to effect and approach of the contact piece of the second lever arm toward the fixed contact piece.

16. An excess-current switch as defined by claim 13, wherein the end-face end of the switch rod has a tripping edge for the bent portion of the second lever arm.

17. An excess-current switch as defined by claim 13, wherein the switch rod has a lateral recess for the end face of the bent portion of the second lever arm, in order in an unintended tripping position of the switch, upon an actuation of the pushbutton, to keep the contact piece of the second lever arm spaced apart from the fixed contact piece by pivoting the switching connector.

18. An excess-current switch as defined by claim 11, wherein the switching connector has a third lever arm, which in the position for switching the switch ON is lockable into a projection of the pushbutton, in order to keep the pushbutton firmly in a position corresponding to the position for switching the switch ON, counter to the force of the button spring.

19. A pushbutton-actuated excess-current switch having thermal tripping, comprising a pivotably supported switching connector including a bell crank which is displaceable, via a switch rod connected with the pushbutton subjected to the pressure of a button spring, in the direction of the switch rod counter to the force of a switch spring acting upon the switching connector and with one of its lever arms lockable into place behind a protrusion of a bimetallic strip, in such a manner that upon a deflection of the bimetallic strip caused by an excess current the protrusion of the bimetallic strip releases the locked-in end of the first lever arm of the switching connector via respective latching edges of the protrusion and of the end of the lever arm, another lever arm of the switching connector being provided with a contact piece with which a fixed contact piece of the switch is associated, wherein the second lever arm of the switching connector, provided with the contact piece, has a bent portion extending outward beyond its contact piece, upon which bent portion the end-face end of the switch rod acts upon an actuation of the pushbutton, in order to displace the switching connector, and associated with one end face of the bent portion of the second lever arm is a stationary running face, along which said end face slides upon the action of the switch rod upon the bent portion, in order by pivoting the switching connector to effect an approach of the contact piece of the second lever arm toward a fixed contact piece.

20. An excess-current switch as defined by claim 19, wherein the switching connector has a third lever arm which in the position for switching the switch ON is lockable in place into an extension of the pushbutton, in order to keep the pushbutton firmly in a position corresponding to the position for switching the switch ON, counter to the force of the button spring.

21. An excess-current switch as defined by claim 20, wherein the third lever arm of the switching connector is embodied, in terms of the pivoting action of the stationary running face upon the switching connector, such that with a fully actuated pushbutton this third lever arm partially overlaps the extension of the pushbutton at a distance from this extension of the pushbutton.

22. An excess-current switch as defined by claim 19, wherein the switch rod has a lateral recess for the end face of the bent portion of the second lever arm, in order in an unintended tripping position of the switch, upon an actuation of the pushbutton, to keep the contact piece of the second lever arm spaced apart from the fixed contact piece by pivoting the switching connector.

* * * * *